US007154464B2

(12) United States Patent
Lee et al.

(10) Patent No.: US 7,154,464 B2
(45) Date of Patent: Dec. 26, 2006

(54) LIQUID CRYSTAL DISPLAY AND DRIVING METHOD THEREOF

(75) Inventors: Seung-Woo Lee, Seoul (KR); Jang-Kun Song, Seoul (KR); Su-Hyun Kwon, Suwon (KR)

(73) Assignee: Samsung Electronics Co., Ltd. (KR)

( * ) Notice: Subject to any disclaimer, the term of this patent is extended or adjusted under 35 U.S.C. 154(b) by 365 days.

(21) Appl. No.: 10/150,163

(22) Filed: May 17, 2002

(65) Prior Publication Data

US 2003/0038766 A1 Feb. 27, 2003

(30) Foreign Application Priority Data

Aug. 21, 2001 (KR) ..... 2001-50419
Sep. 26, 2001 (KR) ..... 2001-59638

(51) Int. Cl.
*G09G 3/36* (2006.01)
*G09G 5/00* (2006.01)

(52) U.S. Cl. ..... 345/96; 345/94; 345/208; 345/209

(58) Field of Classification Search ..... 345/87–102; *G09G 3/36*

See application file for complete search history.

(56) References Cited

U.S. PATENT DOCUMENTS 5,568,163 A * 10/1996 Okumura ..... 345/100
6,567,062 B1 * 5/2003 Kudo et al. ..... 345/92
6,727,878 B1 * 4/2004 Okuzono et al. ..... 345/96

FOREIGN PATENT DOCUMENTS

JP 04322216 A * 11/1992

* cited by examiner

*Primary Examiner*—Alexander Eisen
(74) *Attorney, Agent, or Firm*—Cantor Colburn LLP

(57) ABSTRACT

The present invention relates to a line inversion type liquid crystal display and a driving method thereof. A plurality of pixels arranged in a matrix, a plurality of data lines extending in a row direction and a plurality of gate lines extending in a column direction are disposed in a liquid crystal panel of the liquid crystal display. The pixel has a liquid crystal capacitor for performing display operation and a switching element turned on in response to a gate-on voltage to apply a data signal to the liquid crystal capacitor. A gate driver sequentially provides gate-on pulses to the gate lines based on gate control signals from a timing controller, and a data driver sequentially applies the data signals with polarity inversion, corresponding to color signals from the timing controller based on the data control signal from the timing controller. The polarity of the data signals is inverted by the unit of at least two pixel rows. Since the width of the gate-on pulse applied to the first pixel row with polarity inversion is larger than that of other gate-on pulses, a charging ratio of the first pixel row with polarity inversion is larger than that of the other rows.

24 Claims, 7 Drawing Sheets

LIQUID CRYSTAL DISPLAY AND DRIVING METHOD THEREOF

BACKGROUND OF THE INVENTION (a) Field of the Invention

The present invention relates to a liquid crystal display and driving method thereof.

(b) Description of the Related Art

Generally, a liquid crystal display (LCD), which includes two panels with respective polarizers and a liquid crystal layer with dielectric anisotropy disposed therebetween, is a display device that displays desired images by applying electric field to the liquid crystal layer to control the amount of light passing through the panels. The LCD includes a plurality of pixels arranged in a matrix, a plurality of gate lines transmitting gate signals to the pixels and extending in a row direction, and a plurality of data lines transmitting data signals to the pixels and extending in a column direction. Each pixel includes a liquid crystal capacitor and a switching element connected thereto, and the liquid crystal capacitor has a pixel electrode and a reference electrode for generating electric field in cooperation and a liquid crystal layer interposed therebetween. Each switching element is connected to one gate line and one data line to be turned on or turned off in response to the gate signal, thereby transmitting the data signal to the pixel electrode. The magnitude of the electric field applied to the liquid crystal layer depends on the difference between the voltage of a reference signal (hereinafter, referred to as a reference voltage) applied to the reference electrode and the voltage of the data signal (hereinafter, referred to as a data voltage). The reference electrode and the pixel electrode may be formed on the same panel or different panels.

When gate-on voltages are sequentially applied to the gate lines, the switching elements connected thereto are turned on. At the same time, the data lines connected to the turned-on switching elements are applied with appropriate data voltages, which are applied to the respective pixel electrodes in a pixel row via the turned-on switching elements. In this manner, the gate-on voltages are applied to all the gate lines to supply the data voltages to the pixels in all the rows, and such a cycle is called a frame.

Since the liquid crystal material is generally deteriorated in its nature by continuous application of electric field in one direction, it is necessary to frequently change the field direction by inverting polarities of the data voltages relative to the reference voltage.

Several methods of inverting the polarities of data voltages are suggested, for example, dot inversion of inverting the polarities by the pixel unit, line inversion of inverting the polarities by the row unit, etc. The dot inversion has problems of severe flickering phenomenon in a screen with middle gray such as a window end screen in a liquid crystal display monitor of a computer as well as delay of signal flowing along the data lines and decrease of charging ratio in every row due to the opposite polarities of voltages of neighboring pixel rows. Although the N-line inversion has less signal delay and less charging ratio reduction compared with the dot inversion, it still has problems of signal delay and reduction of the charging ratio in every first row among the rows with the same polarity.

SUMMARY OF THE INVENTION

The present invention solves the above problems and increases the charging ratio of a liquid crystal display being driven with a line inversion.

In one aspect, an LCD of the present invention includes a plurality of gate lines transmitting gate-on pulses, a plurality of data lines transmitting data signals and a plurality of pixels connected to the gate lines and the data lines to perform display operation. Each of the pixels includes a switching element turned on by gate-on pulses from the associated gate lines to receive the data signals from the associated data lines. The width of at least one of gate-on pulses is different from that of other gate-on pulses.

The polarity of at least one of data signals is different from that of other data signals, and the width of gate-on pulse related to the data signals with different polarity may be larger than that of the previous gate-on pulse.

In another aspect, an LCD device according to the present invention includes a plurality of gate lines sequentially transmitting gate-on pulses, a plurality of data lines related to the gate-on pulses to sequentially transmit a plurality of data signals with different polarity, and a plurality of pixels connected to the gate lines and the data lines to perform display operation, and each of the pixels includes a switching element turned on by the gate-on pulses from the gate lines to receive the data signals. In this case, the widths of the gate-on pulses are varied depending on the polarity change of the data signals.

The width of gate-on pulse related to data signal having polarity different from the previous data signal of the data signals is larger than that of gate-on pulse related to the previous the data signal.

In still another aspect, the present invention provides an LCD device including a plurality of pixels, and a plurality of signal lines connected to the pixels to apply image signals thereto, and duration of application of the image signals for at least one of the pixels is different from that of application of image signals for other pixels.

In this case, the polarity of the image signal for at least one pixel has polarity different from the image signal for other pixels, and duration of application of the image signals for the pixel having different polarity may be longer than that of application of the image signal for other pixels.

In yet another aspect, an LCD device according to the present invention includes a plurality of pixels and a plurality of signal lines connected to the pixels to sequentially apply image signals with different polarity thereto, and duration of application of the image signals for the pixels is varied depending on the polarity change of the image signals.

Duration of application of the image signals having polarity different from a previous image signal of the image signals for the pixels may be longer than that of application of the previous image signal for the pixels.

A driving device of an LCD according to an embodiment of the present invention includes a plurality of gate lines applied with gate-on pulses, a plurality of data lines applied with data signals, and a plurality of pixels which have switching elements connected to the gate line and the data line, disposed on areas defined by the gate lines and the data lines, and arranged in a matrix. The driving device includes a timing controller for generating gate control signals including color signals inputted from an external device, data control signals and a first control signal having a pulse period which varies depending on polarity inversion of the data signals, a gate driver sequentially applying the gate-on pulses to the gate lines for selectively turning on the switching elements in synchronization with the gate control signals, and a data driver sequentially applying the data signals corresponding to the color signals to the data lines, while inverting the polarity of the data signals corresponding to the color signals in synchronization with the data control signals.

When the polarity of the data signals is; inverted, the widths of gate-on pulses become larger.

The gate control signals may further include a vertical synchronizing start signal for instructing to begin outputting the gate-on pulses and a gate selection signal for controlling output time of the gate-on pulses, and the first control signal may be a gate-on enable signal for limiting width of the respective gate-on pulses. In this case, the pulse period of the gate selection signal is also varied depending on the pulse period of the gate-on pulse, and the data control signals may include a second control signal having a pulse period which varies depending on the polarity inversion of the data signal.

The gate control signal may further include the vertical synchronizing start signal for instructing to begin outputting the gate-on pulses, and the first control signal may be a gate selection signal for controlling output time of the gate-on pulses. The gate control signals may further include a gate-on enable signal for limiting the widths of the gate-on pulses and the pulses of the gate-on enable signal may be generated only on polarity inversion of the data signals.

The data control signals may be controlled in order to adjust the pulse widths of the data signals, and may be controlled so that the pulse widths of the first data signals with polarity inversion become larger than those of the other data signals. In addition, the gate control signals may be controlled so that the pulse widths of the gate-on pulses related to the first data signal with polarity inversion become larger than those of the other data signals. In this case, the gate control signals may be controlled so that a gate-on pulse related to the first data signal with polarity inversion exists within the range of the pulse widths of the first data signal with polarity inversion. The gate control signals may also be controlled so that the gate-on pulses related to the data signals after the first data signal with polarity inversion overlap previous gate-on pulses.

A method for driving an LCD device including a plurality of pixels having switching elements and arranged in a matrix, a plurality of gate lines transmitting gate-on pulses to the switching elements, and a plurality of data lines transmitting data signals having polarity which is inverted by the unit of at least two data signals to the switching elements, comprises: receiving color signals and a timing signal for controlling the color signals, generating a load signal for determining application time of the data signals on the basis of the timing signal and gate control signals for controlling the gate-on pulses, applying the data signal corresponding to the color signal to the appropriate data line in synchronization with the load signal, and sequentially applying the gate-on pulses to the gate lines in synchronization with the gate control signal. Here, pulse period of at least one of the gate control signals is varied depending on the polarity change of the data signal, and the width of the gate-on pulse related to the first data signal with polarity inversion is larger than that of other gate-on pulses.

The pulse period of the gate signal that varies depending on the polarity inversion of the data signal may be either a gate-on enable signal for limiting the pulse width of the gate-on pulse or a gate selection signal for determining application time of the gate-on pulse, and these are varied either separately or altogether.

When the pulse period of the gate selection signal is varied depending on polarity inversion of the data signal, the pulses of the gate-on enable signal may be generated only prior to the gate-on pulse related to the first data signal with polarity inversion.

Duration of application of the data signal for the data line may be varied depending on the width of the related gate-on pulse, which may be varied by adjusting the pulse interval of the load signal.

A driving method of the LCD according to the present invention further includes loading color signals in synchronization with the data enable signal, wherein the pulse period of the data enable signal may be either kept uniform or varied depending on the polarity of the data signal.

All the neighboring gate-on pulses may not overlap each other. Moreover, the gate-on pulse related to the first data signal with polarity inversion may not overlap the previous gate-on pulse, but the remaining neighboring gate-on pulses may be overlapped each other. In the latter case, the number of the gate-on enable signal may be at least two and is obtained by subtracting one from the number of the data signal with the same polarity. The pulse of the gate-on enable signal may alternately limit the widths of the gate-on pulses generated in sequence.

DETAILED DESCRIPTION OF THE INVENTION

Figure 1:
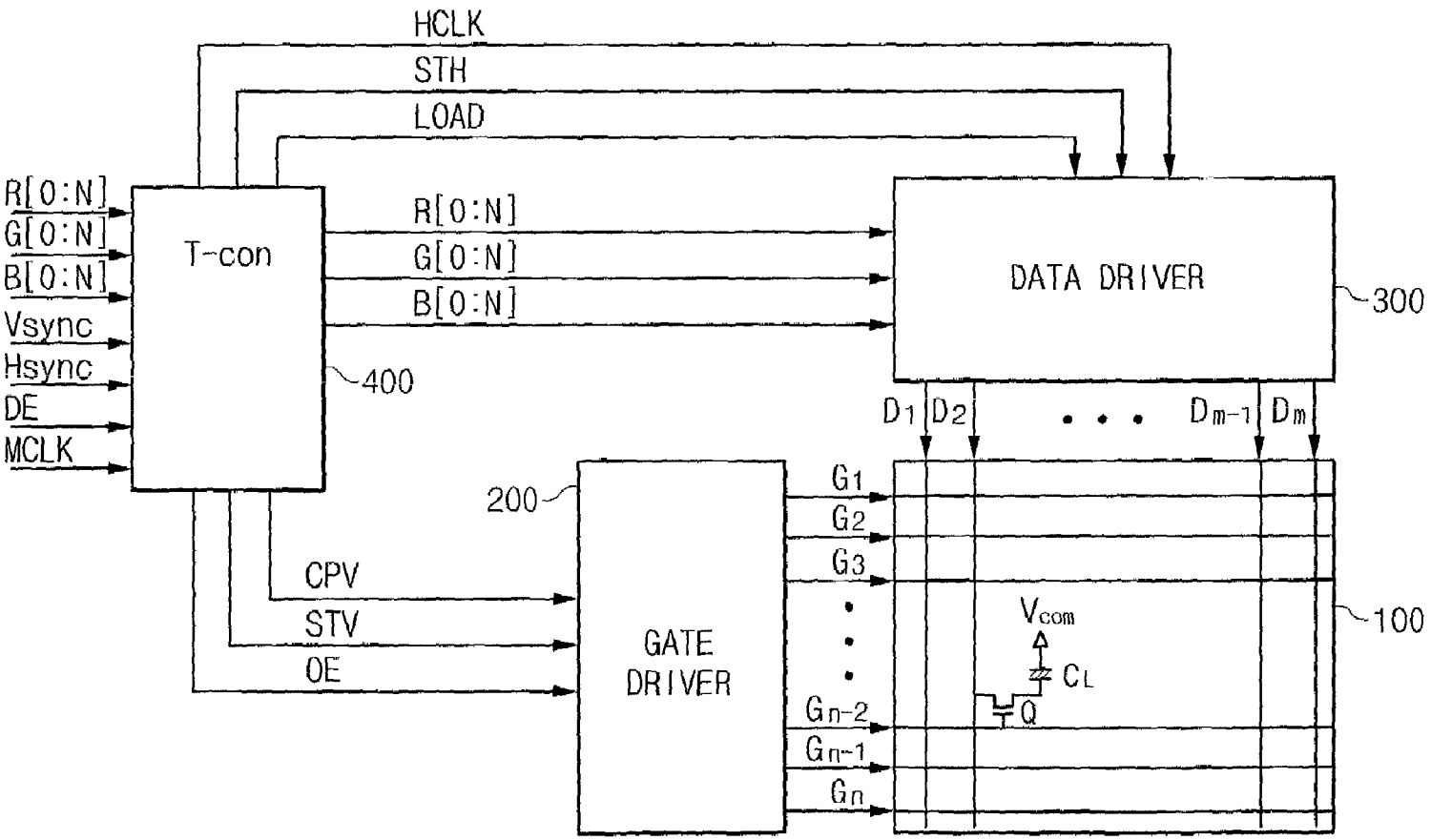
FIG. 1 is a block diagram of a liquid crystal display according to an embodiment of the present invention.

An exemplary embodiment of the present invention will be described with reference to the accompanying drawings for those skilled in the art to exercise the present invention easily. However, the present invention is implemented in many versatile forms, and is not limited to the embodiments. The same reference numerals are used to the parts or components to perform the same function.

FIG. 1 is a block diagram of a liquid crystal display (LCD) according to an embodiment of the present invention.

As shown in FIG. 1, the LCD device according to an embodiment of the present invention includes a liquid crystal panel 100, a gate driver 200 and a data driver 300 connected to the liquid crystal panel 100, and a timing controller 400 for controlling the panel 100 and the drivers 200 and 300.

The liquid crystal panel 100 includes a plurality of signal lines G1–Gn and D1–Dm and a plurality of pixels connected thereto. Each pixel includes switching element Q connected to corresponding ones of the signal lines G1–Gn and D1–Dm and a liquid crystal capacitor $C_L$ connected to the switching element Q. The signal lines include a plurality of scanning signal lines or gate lines G1–Gn, which transmit scanning signals or gate signals and extend in a row direction. The signal lines further include a plurality of image signal lines or data lines D1–Dm, which transmit image signals or data signals and extend in a column direction. The switching element has three terminals including a control terminal connected to one of the gate lines G1–Gn. One of the remaining two terminals is connected to one of the data lines D1–Dm, and the other terminal is connected to the corresponding liquid crystal capacitor $C_L$. FIG. 1 shows a MOS transistor as an example of a switching element, and this MOS transistor is implemented as a thin film transistor having a channel layer made of amorphous silicon or polysilicon in a practical process. The liquid crystal capacitor $C_L$ has two terminals, a pixel electrode connected to the switching element and a reference electrode applied with a reference voltage. The liquid crystal capacitor $C_L$ also includes a liquid crystal layer as a dielectric disposed between the pixel electrode and the reference electrode. The liquid crystal molecules alter their arrangement depending on the electric field generated by the pixel electrode and the reference electrode, thereby changing the polarization of light passing through the liquid crystal layer. This change of the polarization causes the variation of light transmittance by a polarizer (not shown) attached to the liquid crystal panel 100.

The gate driver 200 and the data driver 300 include a plurality of gate driving ICs (integrated circuits) and a plurality of data driving ICs, respectively. The ICs may be chips, which are separately placed external to the liquid crystal panel 100 or mounted on the liquid crystal panel 100. In another example, the ICs may be formed on the liquid crystal panel 100 by the same process as the signal lines G1–Gn, and D1–Dn and the thin film transistors Q. The gate driver 200 and the data driver 300 are respectively connected to the gate lines G1–Gn and the data lines D1–Dm of the liquid crystal panel 100 to apply the gate signals and the data signals thereto. The drivers 200 and 300 are formed on a printed circuit board (not shown) separated from the liquid crystal panel 100, and controlled by the timing controller 400 connected thereto. The controlling operation will be described in detail.

The timing controller 400 is supplied from an external graphic controller (not shown) with RGB color signals R[0:N], G[0:N] and B[0:N] and timing signals controlling the display thereof, for example, a vertical synchronizing signal Vsync, a horizontal synchronizing signal Hsync, a main clock MCLK, a data enable signal DE, etc. In response to the timing signals, the timing controller 400 sends gate control signals to the gate driver 200, and the color signals R[0:N], G[0:N] and B[0:N] and data control signals to the data driver 300.

The gate control signals include a vertical synchronizing start signal STV for instructing to begin outputting gate-on pulses (high sections of the gate signals), a gate selection signal CPV for controlling the output time of the gate-on pulses and a gate-on enable signal OE for limiting the widths of the gate-on pulses. The data control signals include a horizontal synchronizing start signal STH for instructing to begin outputting the color signals, a load signal LOAD or TP for instructing to apply the appropriate data voltages to the data lines, and a data clock signal HCLK.

In response to the vertical synchronizing start signal STV, the gate driver 200 sequentially applies the gate-on pulses to the gate lines G1–Gn in synchronization with the gate selection signal CPV, thereby sequentially turning on the switching elements connected thereto. The width of the gate-on pulse is determined by the gate-on enable signal OE. In response to the horizontal synchronizing start signal STH, the data driver 300 converts the entering color signals R[0:N], G[0:N] and B[0:N] into analog data signals in synchronization with the data clock signal HCLK, and store the converted signals in a shift register (not shown). The stored analog data signals are applied to the corresponding data lines in response to the pulse of the load signal LOAD. Then, the data signals are applied to the corresponding pixels via the turned-on switching elements connected to the related data lines.

The polarity of the data signals is inverted every two or more rows, and the width of the gate-on pulse for at least one row is different from that for other rows. In detail, the width of the gate-on pulse applied to the first pixel row among the adjacent pixel rows which are applied with the data signals having the same polarity (hereinafter, referred to as "first pixel row with polarity inversion") is larger than that applied to the other rows. For example, in the four-line inversion, when the polarity of the (8i+1)-th (i=0, 1, 2, . . . ) to the (8i+4)-th rows is positive and the polarity of the (8i+5)-th to the (8i+8)-th rows is negative, the widths of the gate-on pulses for the (8i+1)-th, (8i+5)-th, (8i+9)-th, . . . , i.e., [8i+(4j+1)]-th (j=0, 1, 2, . . . ) rows are larger than the pulse widths for the other rows. The pulse widths for the other rows may be smaller than a normal width.

This increases the charging ratio for the first pixel row with polarity inversion, which has possessed relatively lower charging ratio. It is noted that since the data signals for the adjacent pixels in the column direction are almost the same when ignoring the polarity, the distortion of the data signals only for the first pixel row with polarity inversion is considerable while that for the other rows is negligible. Accordingly, it is sufficient to modify only for the first row according to the present invention.

In the meantime, the gate-on pulse is generated in synchronization with the gate selection signal CPV, and the width of the gate-on pulse is determined by the gate-on enable signal OE, as described above. For example, the gate signal is allowed to become high only in an enable section where the gate enable signal OE is low. Therefore, by changing the width of the low section or the interval between the pulses (or high sections) of the gate-on enable signal OE, the width of the gate-on pulse can be controlled. Such examples will be described in detail with reference to FIGS. 2 and 3.

Figure 2:
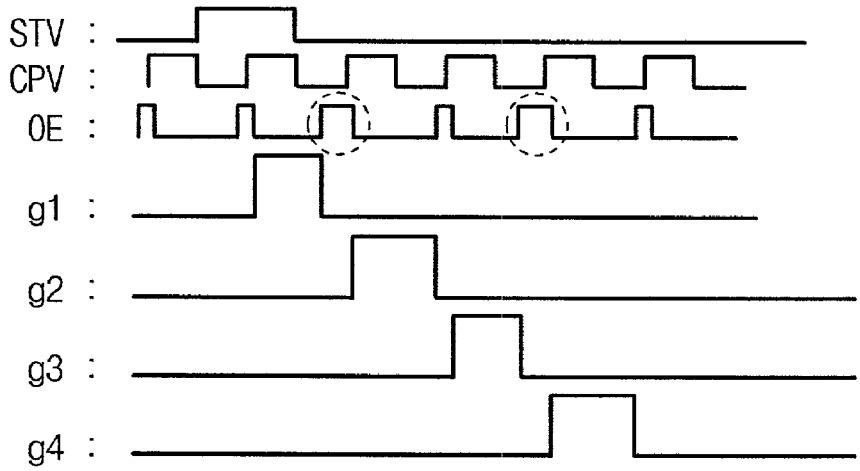
FIGS. 2 and 3 show waveforms of gate signals, gate control signals and data control signals of a two-line inversion type liquid crystal display according to a first embodiment and a second embodiment of the present invention.
Figure 3:
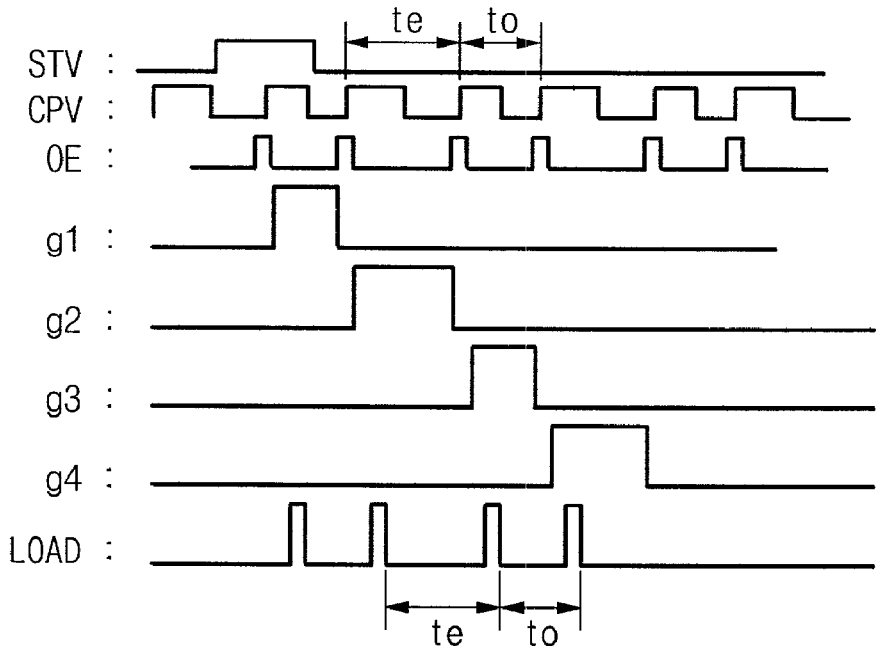

FIGS. 2 and 3 show waveforms of gate control signals STV, CPV and OE, a data control signal LOAD and gate signals g1–gn applied to the gate lines G1–Gn, which are used in two-line inversion where the polarity is inverted every 2k-th(k=1, 2, . . . ) gate lines.

In the first embodiment shown in FIG. 2, the widths of gate-on pulses are adjusted by controlling the period, the widths and/or the intervals of the pulses (high sections) of a gate-on enable signal OE (hereinafter, referred to as "gate-on enable pulses" and indicated by the same reference numeral as the gate-on enable signal). For example, a gate-on enable pulse OE generated after beginning the application of the gate-on pulse to the 2k-th gate line is adjusted to have a pulse width smaller than a normal width and to be delayed by the width difference. Then, the interval from the previous gate-on enable pulse OE becomes larger, and hence the width of the gate-on pulse is increased. On the contrary, by increasing the width of a gate-on enable pulse OE (enclosed by circle) generated after beginning the application of the gate-on pulse to the (2k−1)-th gate line, relative to the normal width, and by generating the pulse OE in advance in amount of the width difference, the interval from the previous gate-on enable pulse OE becomes smaller, and consequently, the width of the gate-on pulse is decreased.

As shown in FIG. 3, the second embodiment increases or decreases the period, the width and/or the interval of the pulses (high sections) of a gate selection signal CPV (hereinafter, referred to as "gate selection pulses" and indicated by the same reference numeral as the gate selection signal), and correspondingly, increases or decreases the width of the associated low sections of a gate-on enable signal OE, thereby adjusting the widths of gate-on pulses. For example, the gate selection pulse CPV corresponding to the gate-on pulse applied to 2k-th gate line is adjusted to have a period $t_e$ larger than a normal period and to increase the pulse in amount of the period difference, and consequently, the widths of the related gate-on pulses are increased. On the contrary, by decreasing the period $t_o$ of the gate selection pulse CPV associated with the gate-on pulse applied to (2k−1)-th gate line relative to a normal period, and by decreasing the width of the low interval of the gate-on enable signal OE, accordingly, the widths of the related gate-on pulses are decreased.

In this embodiment, since the intervals of the gate selection pulses CPV are not uniform, the generating time of the pulses (high sections) of the load signal LOAD (hereinafter, referred to as "load pulses" and indicated by the same reference numeral as the load signal) varies in relation to the intervals of the gate selection pulses CPV, as shown in FIG. 3.

The features of the first and the second embodiments are applicable not only for two-line inversion but also for multi-line inversion as three-line inversion, four-line inversion, etc. That is, the widths of enable sections (i.e., low sections) of the gate-on enable signal OE related to the first row with the inverted polarity are increased in order to obtain the sufficient charging time for the first row.

As can be seen in the foregoing two embodiments, the high sections of the gate signals are controlled by the gate-on enable signal OE in the line inversion. The gate signals become high when the gate-on enable signal OE is low, and the high section of the gate-on enable signal OE is interposed between the every neighboring two gate-on pulses, i.e., the high sections of the gate signals. Then, the gate-on pulse is applied to the present gate line after the gate-on pulse applied to the previous gate line is blocked.

The reason of placing a gap between the gate-on pulses is that, if not, the gate on pulses applied to the neighboring two gate lines may be overlapped, and thus pixels in corresponding rows are simultaneously applied with the same data signals. Therefore, it is difficult to obtain desired images.

However, as described above, since the data signals supplied for the adjacent pixels in the column direction are almost the same, the application of any one of the two signals with the same polarity to the neighboring rows with the same polarity hardly affects the desired images. However, when the data signals having nearly the same magnitude but opposite polarity are simultaneously applied to a row at a border where the polarity is inverted, the difference between the two signals is relatively large, and this causes serious problems such as distortion of images, etc.

Therefore, the high section of the gate-on enable signal OE is interposed between the gate-on pulses for the two rows with the inverted polarity but not between the remaining rows, and thus the charging time for the remaining rows can be increased.

A driving method of an LCD device utilizing this feature according to a third embodiment of the present invention will be described with reference to FIGS. 4 to 6.

Figure 4:
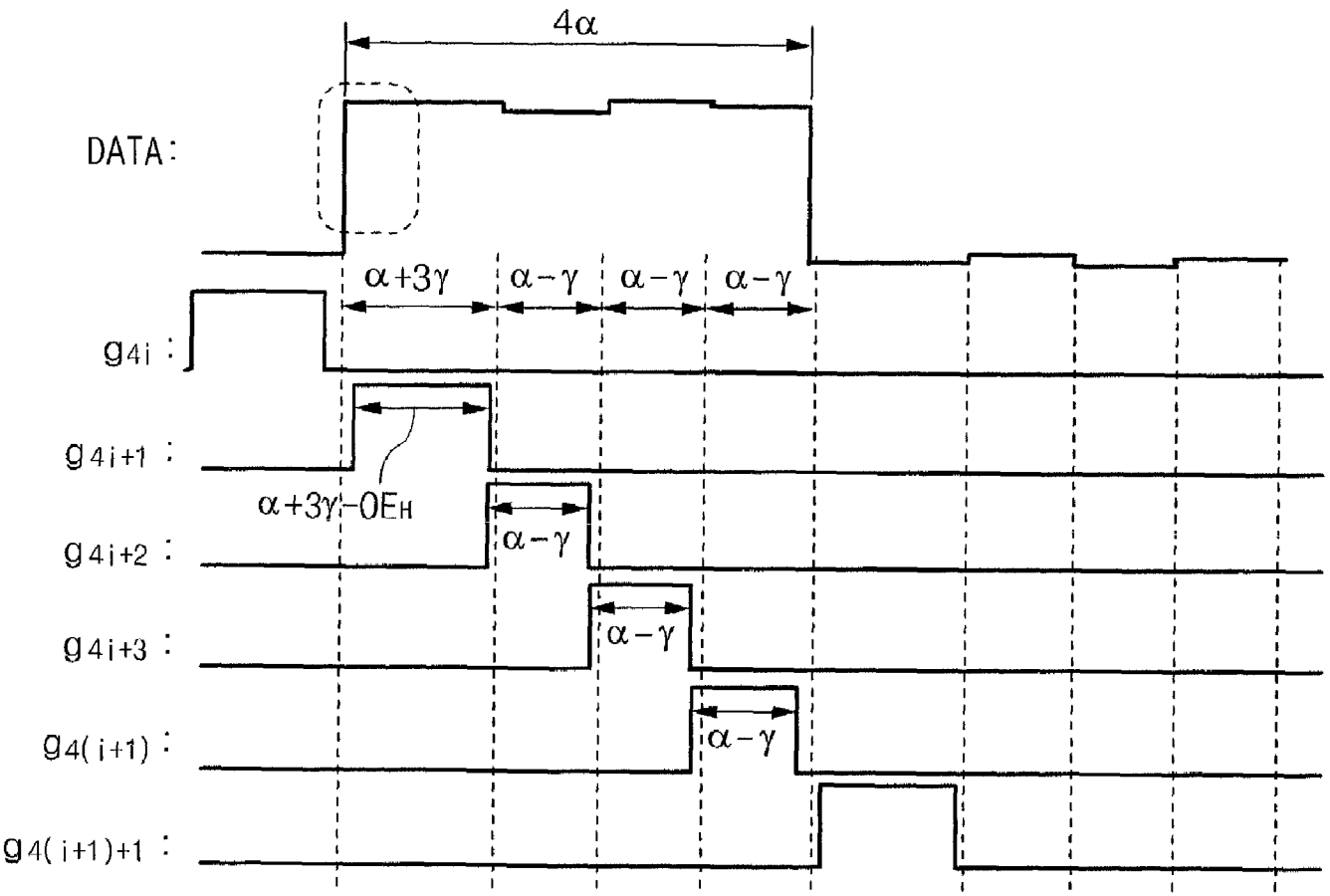
FIG. 4 shows waveforms of gate signals and data signals a four-line inversion type liquid crystal display according to a third embodiment of the present invention.

FIG. 4 shows waveforms of driving signals of a four-line inversion type liquid crystal display according to the third embodiment of the present invention, and illustrates gate signals and data signals for 4i-th to ((4i+1)+1)-th rows.

Assuming that the normal pulse width of a data signal is $\alpha$, the sum of the widths of data signals DATA applied to a bundle of pixel rows, e.g., four pixel rows with the same polarity becomes $4\alpha$. In the present embodiment, while the sum of the widths of the data signals DATA is kept $4\alpha$, the width of a data signal DATA for the first row with polarity inversion is made to be $(\alpha+3\gamma)$, and the width of each data signal DATA applied to the second row to the fourth row is made to be $(\alpha-\gamma)$, where $\gamma$ is a correction width.

In addition, the width of a high section of a gate signal $g_{4i+1}$ applied to a gate line of the first pixel row with polarity inversion is made to be $(\alpha+3\gamma-OE_H)$ (where $OE_H$ is the width of the high section of OE), and the width of the high section of each gate signal $g_{4i+2}$, $g_{4i+3}$, $g_{4(i+1)}$ for the second row to the fourth row is made to be $(\alpha-\gamma)$.

Furthermore, the high section of the gate-on enable signal OE is generated on the polarity inversion, that is, between the high section of the gate-on signal $g_{4i}$ and that of the gate-on pulse $g_{4i+1}$, but not generated for the remaining periods.

For a four-line inversion type liquid crystal display driven by the same manner as the second embodiment, the charging time for every 4 row is $(4\alpha-4OE_H)$, but for this embodiment the charging time is $(4\alpha-OE_H)$, which indicates the charging time of the pixels to be longer.

Figure 5:
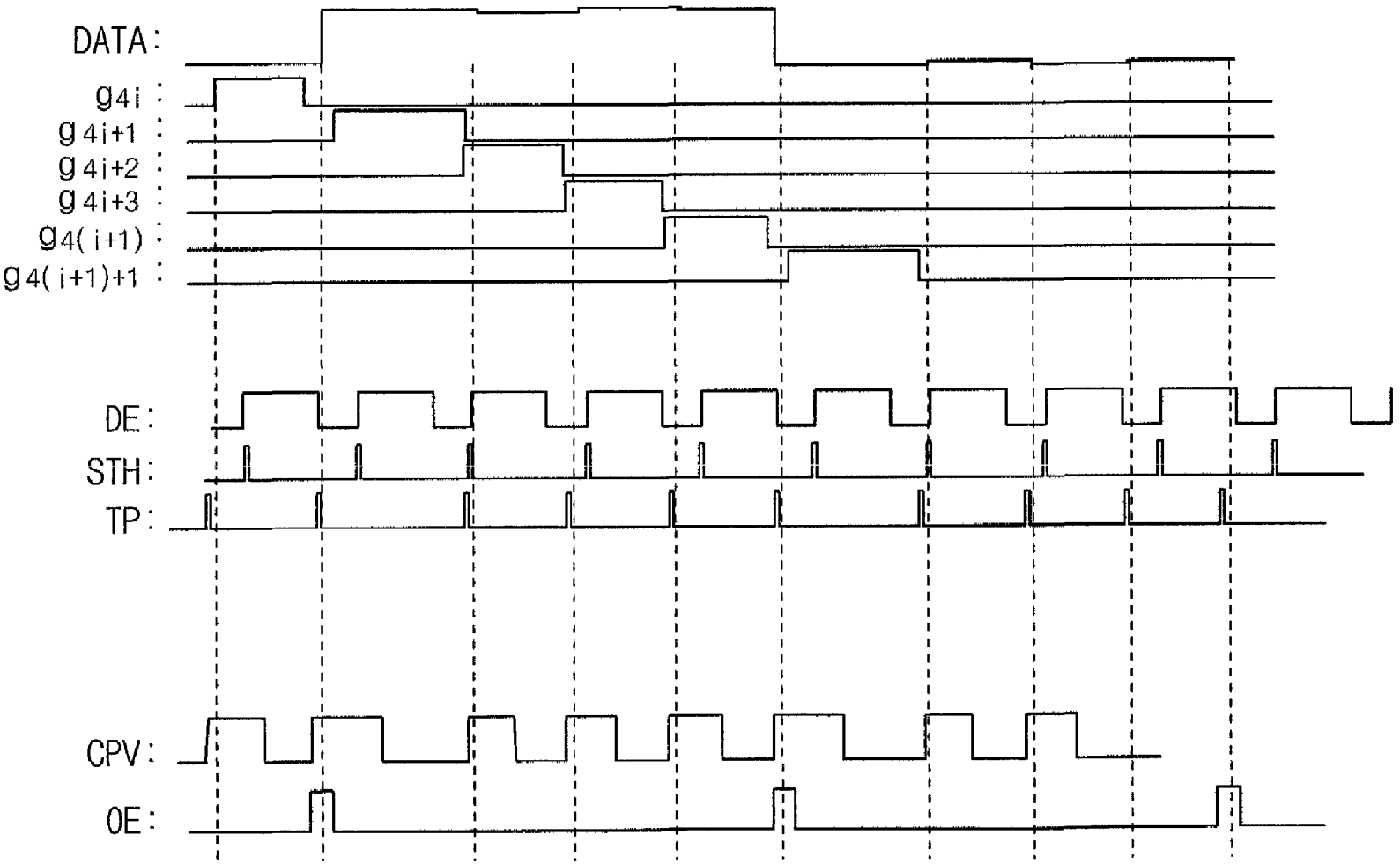
FIGS. 5 and 6 show waveforms of several signals required for generating the gate signals and the data signals shown in FIG. 4.
Figure 6:
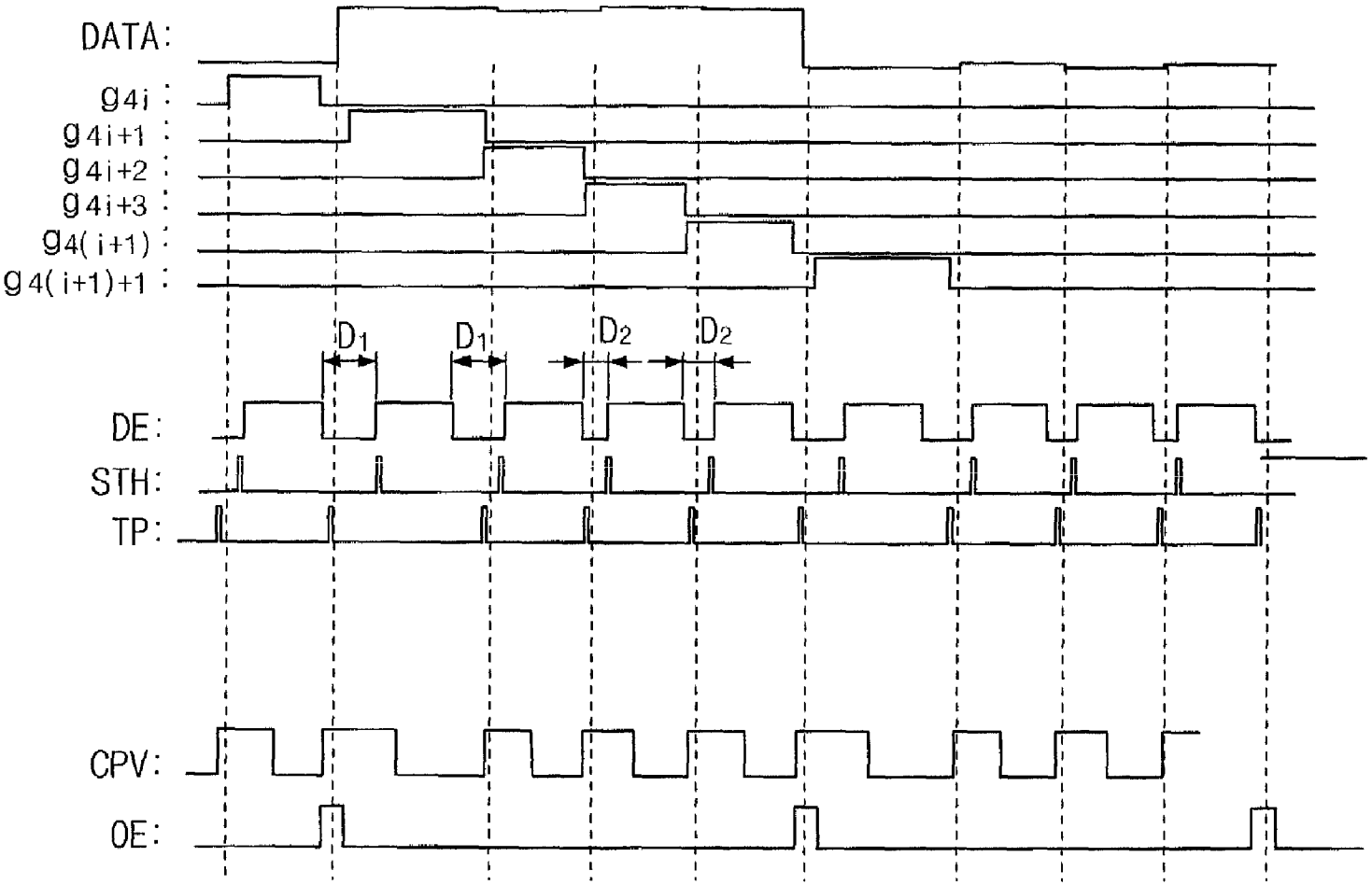

FIGS. 5 and 6 illustrate several exemplary waveforms of signals for generating the gate signals in FIG. 4.

As shown in FIGS. 5 and 6, the pulse widths of the data signals DATA are changed by controlling the generating points of pulses of a load signal TP applied to the data driver 300 (referring to FIG. 1). For example, the interval of the load pulse TP between the first row with polarity inversion and the second row is made to be $(\alpha+3\gamma)$, and the intervals thereof between the second row and the third row, between the third row and the fourth row, and between the fourth row and the next first row are made to be $(\alpha-\gamma)$.

A gate selection signal CPV is also changed. In the case of a four-line inversion as this embodiment, the pulse period of the gate selection signal CPV for the (4i+1)-th row is made to be longer than a normal pulse period, while those for the remaining rows are made to be shorter than the normal pulse period.

FIGS. 5 and 6 illustrate two examples of such driving ways.

In the example shown in FIG. 5, a data enable signal DE supplied for the timing controller 400 (referring to FIG. 1) is used without any modification, and thus the enable sections (i.e., the high sections) and the disable sections (i.e., the low sections) thereof are uniform. In this case, since the width of the data signal for the first row where polarity is inverted is designed to accommodate only one enable section of the data enable signal DE, the following relation is satisfied: $\alpha+3\gamma<E+2D$ (where E and D are widths of the enable section and the disable section of the DE signal, respectively). The width E of the enable section of the data enable signal DE is typically designed to be smaller than the width a of the data signal (i.e., $E<\alpha$). Therefore, the relation $$E+3\gamma<\alpha+3\gamma<E+2D$$

is established, and this leads to:

$$3\gamma<2D.$$

For an LCD with SXGA resolution, since the disable section of the data enable signal DE is usually about 3.5 μs, the correction width γ is determined as the value satisfying the inequality, $3\gamma<7$ μs.

In the case of FIG. 6, the timing controller 400 adjusts the widths of the disable sections of a data enable signal DE supplied therefor and thus changes the generating point of pulses of a horizontal synchronizing start signal STH. As shown in FIG. 6, the width $D_1$ of disable sections of which one is before and the other is after an enable section of the data enable signal DE for the first row where the polarity is inverted is made to be longer while the width $D_2$ of the other disable sections is made to be shorter, depending on the correction width γ. For this reason, it is desired that the color signals are forced to be shifted by a suitable time interval using a line memory installed in the timing controller 400.

Advantage of the example of FIG. 6 is that the correction width γ is not restricted, and thus it is possible to increase the charging time of the data signals for the first row where the polarity is inverted as desired.

As described above, the intervals are interposed only between the gate-on pulses for the two pixel rows at the polarity inversion, but not between the remaining pulses in the third embodiment. According to an embodiment, the remaining pulses are made to be overlapped. As described above, because the data signals inputted to the adjacent pixel in the column direction are nearly the same, the application of any one of the two signals to the adjacent rows with the same polarity causes no problems. This will be described with reference to FIGS. 7 and 8.

Figure 7:
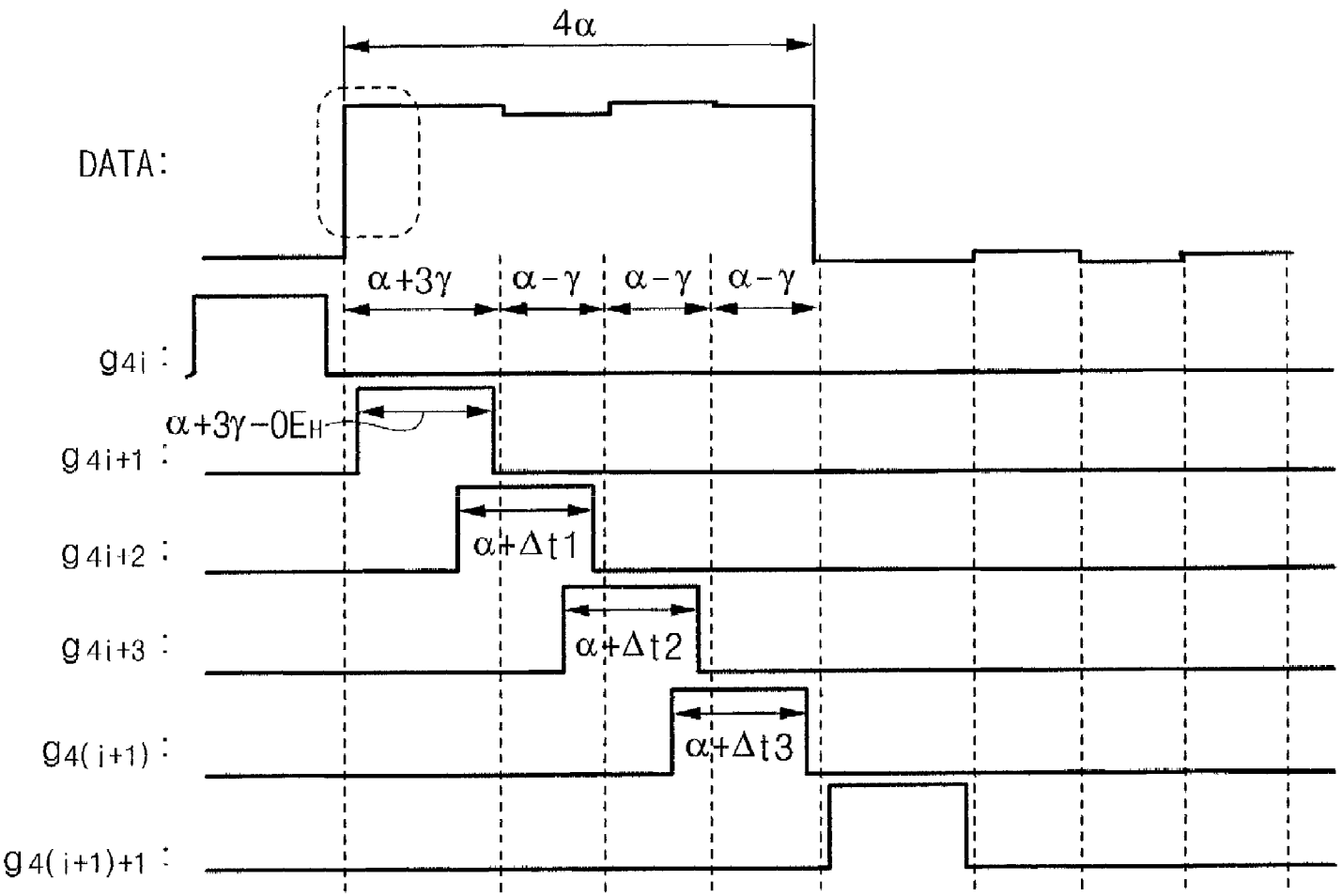
FIG. 7 shows waveforms of gate signals and data signals of a four-line inversion type liquid crystal display according to a fourth embodiment of the present invention.

FIG. 7 shows waveforms of driving signals of a four-line inversion type LCD according to the fourth embodiment of the present invention, and illustrates gate signals and data signals for the 4i-th to the ((4i+1)+1)-th rows.

As in FIG. 7, while maintaining the sum of the widths of the data signals DATA applied to the four pixel rows with the same polarity to be 4α, the width of a data signal DATA for the first row with polarity inversion is made to be (α+3γ), and that for the second row to the fourth row is made to be (α−γ), respectively.

Moreover, the width of the high section of a gate signal $g_{4i+1}$ applied to a gate line for the first row of the polarity being inverted is made to be ($\alpha+3\gamma-OE_H$), and the widths of gate signals $g_{4i+2}$, $g_{4i+3}$, $g_{4(i+1)}$ applied to the second gate line to the fourth gate line are made to be ($\alpha+\Delta t_1$), ($\alpha+\Delta t_2$) and ($\alpha+\Delta t_3$), respectively. Here, $\Delta t_1$ to $\Delta t_3$ may have either the same value or different value. In addition, there is a gap between the high sections of the gate signals $g_{4i}$ and $g_{4i+1}$ for two rows at the polarity inversion. On the contrary, the high sections of the remaining gate signals overlap, that is, a gate signal applied to a gate line becomes high before a gate signal applied to the previous gate line becomes low. For this reason, the charging ratio becomes longer than that of the third embodiment.

Figure 8:
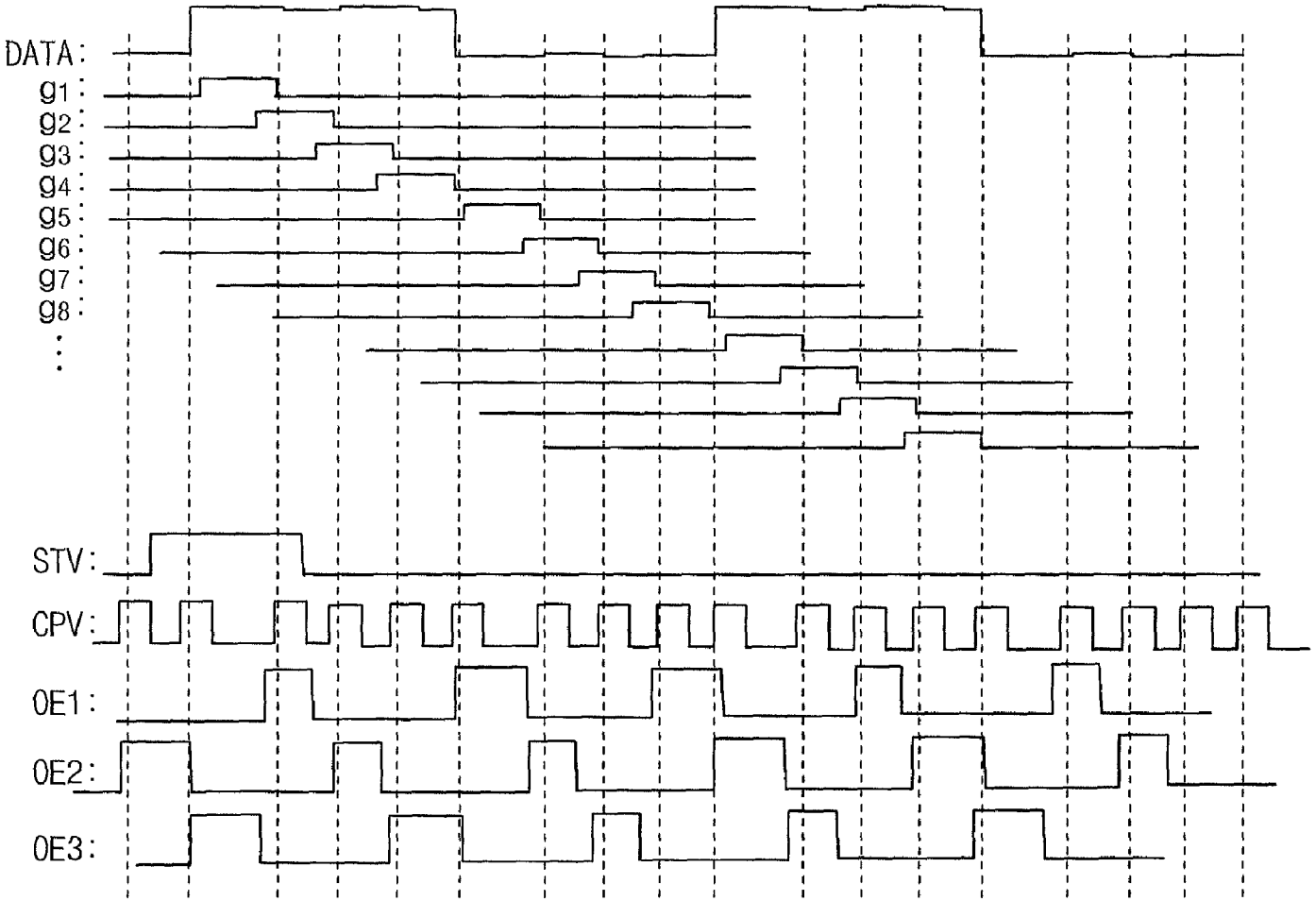
FIG. 8 shows waveforms of several signals required for generating the gate signals and the data signals shown in FIG. 7.

FIG. 8 illustrates various exemplary waveforms for generating the gate signals of FIG. 7.

Although not shown in FIG. 8, since data control signals DE, STH and TP are generated in the same manner as the third embodiment, the detailed description thereof is omitted. A process for generating overlapped gate-on pulses using a vertical synchronizing start signal STV and gate-on enable signals OE1, OE2 and OE3 will be described.

First, the pulse of a vertical synchronizing start signal STV is made to be larger than a normal width, for example, to accommodate two gate selection pulses CPV. Then, two overlapped gate-on pulses are generated.

Thereafter, since the gate-on pulses overlap three times in view of four rows as an inversion unit, the gate-on pulses are controlled by using three gate-on enable signals OE1, OE2 and OE3. Each of the gate-on enable signals OE1, OE2 and OE3 is repeated by 12 pixel rows, and the signal OE2 is made by shifting the signal OE1 by 4 rows, and the signal OE3 is made by shifting the signal OE2 by 4 rows. The signal $OE_j$(j=1, 2, 3, . . . ) blocks the gate-on pulses of the (3i+j)-th (i=0, 1, 2, . . . ) gate lines.

Although the third and the fourth embodiments of the present invention have been described with reference to the four-line inversion, it is apparent that they are applicable to all of the N-line inversions. For example, in the case of the N−line inversion, the width of gate-on pulses can be controlled by using (N−-1) gate-on enable signals.

As described above, according to the present invention, the charging ratio becomes higher by enlarging the width of gate-on pulses applied to the gate lines for the first row where the polarity is inverted. In addition, by interposing a gap between gate-on pulses applied to gate lines for two rows at the polarity inversion, the data signals for the two rows are made not to overlap.

Although the present invention has been described with reference to the preferred embodiments, those skilled in the art will appreciate that the present invention will be variously modified and changed in the scope without departing from spirit and scope of the present invention described in the following claims.

What is claimed is:

1. A device for driving a liquid crystal display including a plurality of gate lines provided with gate-on pulses, a plurality of data lines provided with data signals and a plurality of pixels which have switching elements connected to the gate lines and the data lines, disposed on areas defined by the gate lines and the data lines, and arranged in a matrix, the device comprising:

a timing controller outputting color signals for image display, data control signals and gate control signals, the gate control signals including a first control signal having a plurality of pulses having different widths which varies depending on polarity change of the data signals, the polarity change of the data signals being in turn performed every at least two rows of the matrix;

a gate driver sequentially applying to the gate lines the gate-on pulses for selectively turning on the switching elements based on to gate control signals; and a data driver sequentially applying the data signals corresponding to the color signals to the data lines while inverting polarity of the data signals based on the data control signals.

2. The device of claim 1, wherein width of the gate-on pulses becomes longer on the polarity inversion of the data signals.

3. The device of claim 1, wherein the gate control signals further comprise:

a vertical synchronizing start signal for instructing to begin outputting the gate-on pulses; and a gate selection signal for controlling output time of the gate-on pulses, wherein the first control signal is a gate-on enable signal for cutting width of the respective gate-on pulses.

4. The device of claim 3, wherein pulse period of the gate selection signal is varied depending on pulse period of the gate-on pulses.

5. The device of claim 4, wherein the data control signals comprise a second control signal having the pulse period which varies depending on polarity inversion of the data signals.

6. The device of claim 1, wherein the data control signals are controlled so that pulse width of the data signals is adjusted.

7. The device of claim 6, wherein the data control signals are controlled so that pulse width of a first data signal with polarity inversion is larger than pulse width of the remaining data signals.

8. The device of claim 7, wherein the data control signals are controlled so that width of the gate-on pulse related to the first data signal with polarity inversion is larger than width of the gate-on pulses related to the remaining data signals.

9. The device of claim 8, wherein the gate control signals are controlled so that a gate-on pulse related to the first data signal with polarity inversion exist within the pulse width of the first data signal with polarity inversion.

10. The device of claim 9, wherein the gate control signals are controlled so that the gate-on pulses related to the data signals after the first data signal with polarity inversion overlap previous gate-on pulses.

11. The device of claim 1, wherein the width of the gate-on pulses is defined by a time period between adjacent edges of adjacent pulses of the first control signal.

12. A method for driving a liquid crystal display including a plurality of pixels having switching elements and arranged in a matrix, a plurality of gate lines transmitting gate-on pulses to the switching elements, and a plurality of data lines transmitting data signals with polarity inversion by the unit of at least two data signals to the switching elements, the polarity change of the signals being in turn performed every at least two rows of the matrix;

the method comprising:

receiving color signals and a timing signal for controlling the color signals from an external device;

generating a load signal for determining application time of the data signals on the basis of the timing signal, supplying the data signals corresponding to the color signals to the appropriate data lines in synchronization with the load signal;

generating gate control signals for controlling the gate-on pulses on the basis of the timing signal, and sequentially applying the gate-on pulses to the gate lines in synchronization with the gate control signals, wherein at least one of the gate control signals includes a plurality of pulses having different widths that depends on the polarity inversion of the data signals, and the gate-on pulse related to a first data signal with polarity inversion has larger width than the other gate-on pulses.

13. The method of claim 12, wherein the at least one of the gate control signals comprises a gate-on enable signal for cutting pulse width of the gate-on pulses.

14. The method of claim 13, wherein the gate control signals further comprise a gate selection signal for determining the application time of the gate-on pulses.

15. The method of claim 14, wherein pulse period of the gate selection signal is varied depending on the polarity inversion of the data signals.

16. The method of claim 12, wherein the neighboring gate-on pulses do not overlap each other.

17. The method of claim 12, wherein the gate-on pulse related to the first data signal with polarity inversion does not overlap the previous gate-on pulse, and other neighboring gate-on pulses overlap each other.

18. The method of claim 17, wherein the gate control signals comprise at least two gate-on enable signals, the number of which is obtained by subtracting one from the number of the neighboring data signals with the same polarity unit.

19. The method of claim 18, wherein pulses of the gate-on enable signals alternately limit the widths of the gate-on pulses generated in sequence.

20. The method of claim 12, wherein duration of application of the data signals for the data lines is varied depending on the width of the related gate-on pulse.

21. The method of claim 20, wherein the duration of application time of the data signals is varied by adjusting pulse intervals of the load signal.

22. The method of claim 21, further comprising loading the color signals in synchronization with a data enable signal having a uniform pulse period.

23. The method of claim 21, further comprising loading the color signals in synchronization with a data enable signal having a pulse period which varies depending on the polarity of the data signals.

24. The device of claim 12, wherein the width of the gate-on pulses is defined by a time period between adjacent edges of adjacent pulses of the at least one of the gate control signals.

* * * * *